US006335703B1

(12) United States Patent
Chang et al.

(10) Patent No.: US 6,335,703 B1
(45) Date of Patent: Jan. 1, 2002

(54) PATCH ANTENNA WITH FINITE GROUND PLANE

(75) Inventors: Li-Chung Chang, Whippany; James A. Housel, Stockton; Ming-Ju Tsai, Livingston, all of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/515,950

(22) Filed: Feb. 29, 2000

(51) Int. Cl.[7] ..... H01Q 1/38
(52) U.S. Cl. ..... 343/700 MS; 343/839
(58) Field of Search ..... 343/700 MS, 761, 343/839; H01Q 1/38

(56) References Cited

U.S. PATENT DOCUMENTS 6,031,502 A * 2/2000 Ramanujam et al. ..... 343/839
6,052,086 A * 4/2000 Kudoh ..... 343/700 MS

* cited by examiner

*Primary Examiner*—Michael C. Wimer
(74) *Attorney, Agent, or Firm*—Priest & Goldstein, PLLC

(57) ABSTRACT

A patch antenna is described with enhanced beamwidth characteristics. In a first embodiment, the antenna comprises a patch element and a ground plane separated from the patch element by a first dielectric layer. The antenna further includes a signal feed line separated from the ground plane by a second dielectric layer, the signal feed line being shielded from the patch element by the ground plane. The signal feed line is electromagnetically coupled to the patch element through an aperture in the ground plane lying across the signal feed line, the ground plane functioning as a finite surface relative to the aperture. According to a further aspect of the invention, the beamwidth of the antenna is adjusted by adjusting the position of a reflector behind the signal feed line. Thus, the present invention provides an efficient way to achieve adjustable wide-beamwidth for various wireless systems in a three-sector configuration.

23 Claims, 7 Drawing Sheets

PATCH ANTENNA WITH FINITE GROUND PLANE

BACKGROUND OF THE INVENTION

1. Field of the Invention

The present invention relates generally to improvements to antennas, and more particularly to advantageous aspects of a patch antenna with a finite ground plane.

2. Description of the Prior Art

In a microstrip patch antenna, the radiator is typically provided by a metallic patch element that has been fabricated, using microstrip techniques, onto a dielectric substrate above a ground plane. Because of their low profile, low cost, and compact size, microstrip patch antennas are suitable for various microwave antenna and antenna array applications. Microstrip patch antennas are used, for example, as the radiating elements of designs based on a microwave integrated circuit (MIC) or monolithic microwave integrated circuit (MMIC) such as those used in aircraft and satellite communications, in missile and rocket antenna systems, as well as personal communication system (PCS) wireless applications. However, one problem associated with microstrip patch antennas is that they typically have a limited beamwidth, compared with, for example, antenna designs employing a dipole element. In addition, current microstrip patch antenna designs do not provide for a compact, cost-efficient mechanism for adjusting the antenna beamwidth.

The prior art can be better understood with reference to FIG. 1, which shows a cutaway perspective view of a microstrip patch antenna 10 according to the prior art. As shown in FIG. 1, the antenna 10 comprises a square patch element 12, a ground plane 14, and a microstrip feed line 16, lying on parallel planes defined by the top and bottom surfaces of a pair of dielectric substrates 18 and 20. The patch element 12 is fabricated onto the top surface of the upper substrate 18, the ground plane 14 is fabricated between the bottom surface of the upper substrate 18 and the top surface of the lower substrate 20, and the feed line 16 is fabricated onto the bottom surface of the lower substrate 20. A fixed metal plate reflector 22 is provided at the bottom of the antenna 10 to reflect radiation towards the top of the antenna 10. Coupling between the feed line 16 and the patch element 12 is provided by a small rectangular aperture 24 in the ground plane 14 that lies across the feed line 16. Because of this coupling technique, the design shown in FIG. 1 is known as an "aperture-coupled patch antenna." Other designs are also used, employing different techniques to couple the feed line to the patch element.

In current aperture-coupled patch antenna designs, the ground plane 14 is significantly larger than the aperture 24 such that, from an electromagnetic perspective, the ground plane 14 functions as an infinite surface relative to the aperture 24. This helps the isolation between the feed line 16 and the patch element 12. In addition, the use of an infinite ground plane makes analysis of the antenna much easier because the equivalence theorem can be applied.

An antenna's radiation pattern is important in antenna applications. It includes several parameters to characterize the antenna performance, including gain, 3 dB (half-power) beamwidth, side-lobe level, front-to-back (F/B) ratio, polarization, cross-polarization level, and the line. The 3 dB beamwidth parameter is the main parameter to show the coverage of radiated energy. The beamwidth of a conventional patch antenna is approximately 60° to 70°.

Because of their high level of integration, patch antennas have been used successfully to form large arrays for highly directional applications. However, other applications require a beam width of greater than the currently available 60° to 70°. For example, a typical three-section cellular system needs to cover a 120° geographic area. In a time division multiple access (TDMA) system, the base station requires an antenna with a 3 dB beamwidth of 105° to 110°, and a code division multiple access (CDMA) system requires a 3 dB beamwidth of 90°. Because of the beamwidth limitations of conventional patch elements, a dipole element is typically used instead in these applications.

In addition, it is desirable for the beamwidth of an antenna to be adjustable in certain applications. A dipole element with an angular reflector can be employed to provide beamwidth control by mechanically adjusting the reflector angle. However, this approach requires sophisticated mechanical structures which may not be cost effective, and which may also result in an undesirably large package size to accommodate these structures.

SUMMARY OF THE INVENTION

One aspect of the invention provides a microstrip patch antenna with enhanced beamwidth characteristics. In a first embodiment, the antenna comprises a patch element and a ground plane separated from the patch element by a first dielectric layer. The antenna further includes a signal feed line separated from the ground plane by a second dielectric layer, the signal feed line being shielded from the patch element by the ground plane. The signal feed line is electromagnetically coupled to the patch element through an aperture in the ground plane lying across the signal feed line, the ground plane functioning as a finite surface relative to the aperture. According to a further aspect of the invention, the beamwidth of the antenna is adjusted by adjusting the position of a reflector behind the signal feed line. Thus, the present invention provides an efficient way to achieve adjustable wide-beamwidth that may be used, for example, in wireless systems in a three-sector configuration.

Additional features and advantages of the present invention will become apparent by reference to the following detailed description and accompanying drawings.

DETAILED DESCRIPTION

One aspect of the present invention provides a microstrip patch antenna with enhanced beamwidth capabilities. The antenna has a patch element, a ground plane separated from the patch element by a first dielectric layer, and a signal feed line separated from the ground plane by a second dielectric layer. The signal feed line is shielded from the patch element by the ground plane, and the signal feed line is electromagnetically coupled to the patch element through an aperture in the ground plane lying across the signal feed line. As explained below, according to the present invention, the ground plane functions as a finite surface relative to the aperture.

Figure 1:
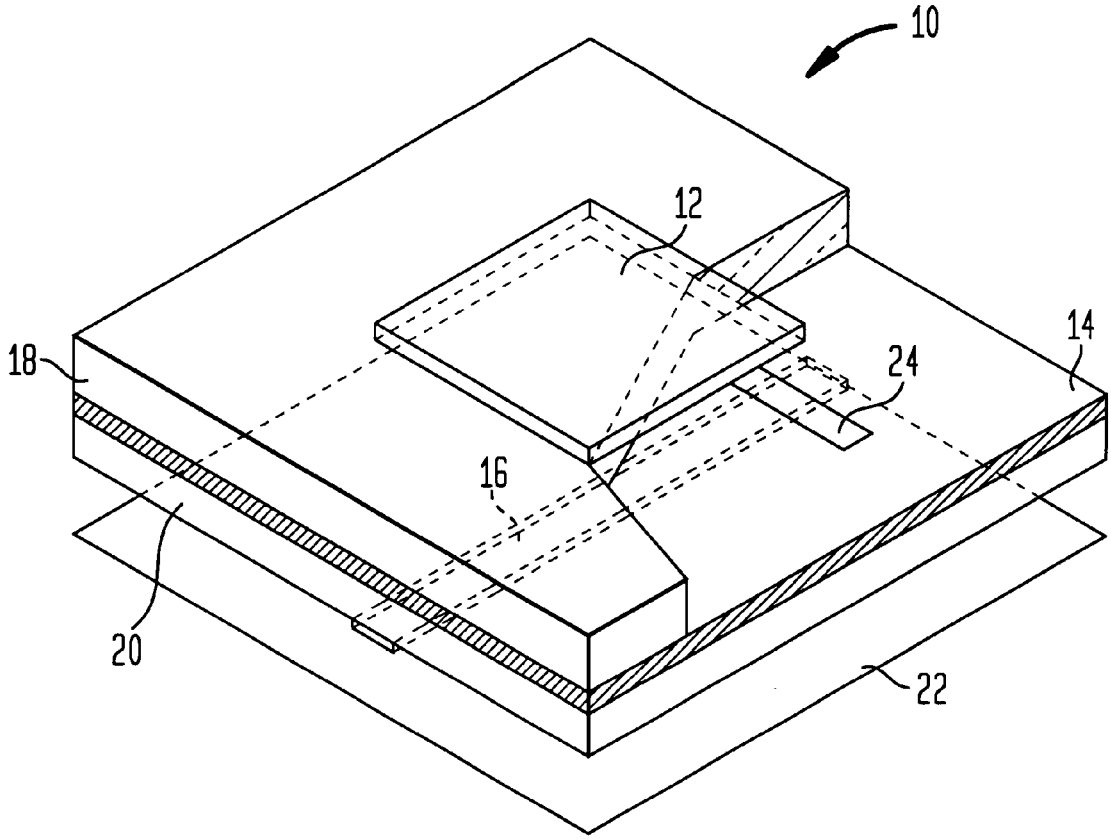
FIG. 1 (PRIOR ART)
FIG. 1 shows a partial cutaway perspective view of a microstrip patch antenna according to the prior art.
Figure 2:
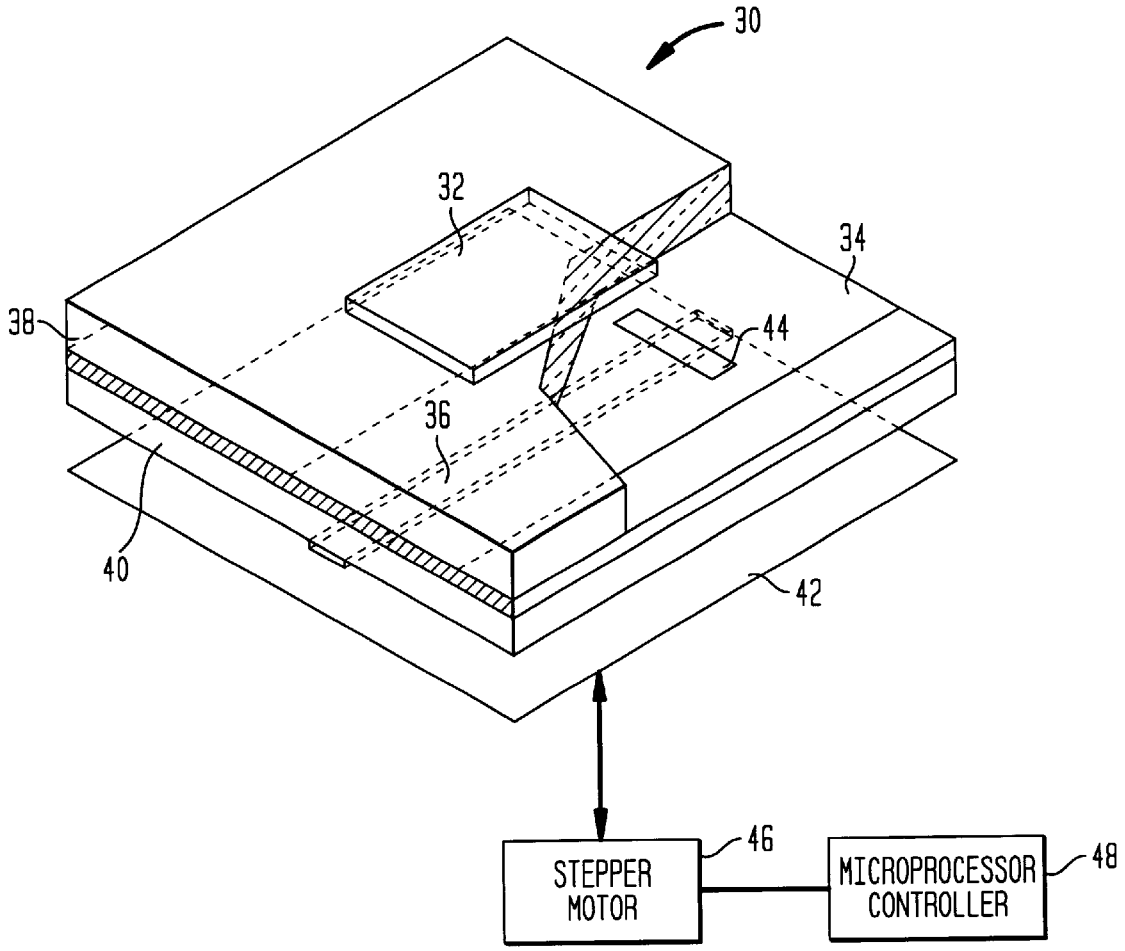
FIG. 2 shows a partial cutaway perspective view of a first embodiment of a microstrip patch antenna according to the present invention.

FIG. 2 shows a partial cutaway perspective view of a first embodiment of a patch antenna 30 according to the present invention. The FIG. 2 patch antenna 30 includes a patch element 32, a finite ground plane 34, and a microstrip feed line 36 lying on parallel planes defined by upper and lower substrates 38 and 40. A reflector 42 is provided to reflect radiation towards the top of the antenna 30. The patch element 32 is coupled to the microstrip feed line 36 by a rectangular aperture 44 in the finite ground plane 34.

The dimensions of the finite ground plane 34 are chosen such that it behaves as a finite surface relative to the aperture 44. The upper limit of the ground plane width is dictated by the edge diffraction conditions which, in the present embodiment of the invention, are derived from the distance of the edges of the ground plane 34 to the radiation caustic, namely, the patch element 32. Therefore, in the present embodiment of the invention, the definition of the "finite" ground plane 34 is that the width of the ground plane 34 is less than one-half wavelength of the operation frequency ($0.5\lambda$) to allow measurable beamwidth variation due to variant reflector positions. Also, the width of the ground plane 34 is more than 1.5 times the width of the patch element 32 to allow a good voltage standing wave ratio (VSWR) performance.

Although the use of a finite ground plane complicates the analysis of the antenna 30, it has been found that the finite ground plane 34 significantly enhances the beamwidth of the antenna 30. As addressed further below, it has been found that by using a suitably dimensioned finite ground plane, the beamwidth of the antenna can be increased to 85°.

It has also been found that the beamwidth capabilities of the antenna 30 are further improved by modifying the shape of the patch element 32. In current patch antennas, the patch element is typically square. However, it has been found that with a finite ground plane 34, it is advantageous to use a rectangular patch element 32, where the width of the patch element 34 is 60 percent of its length or narrower. (It should be noted that, in a wide beamwidth application, the 60 percent width satisfies the above criteria for a finite ground plane.) The use of the rectangular patch element 32 in combination with the finite ground plane 34 has been shown to increase the beamwidth of the antenna 30 to 90°.

Further, the FIG. 2 antenna 30 provides a system for adjusting the antenna beamwidth. Using a finite ground plane 34, it has been found that it is possible to adjust the beamwidth of the antenna 30 by adjusting the position of the reflector 42 relative to the microstrip feed line 36. Moving the reflector 42 away the feed line 36 increases the "spill" of radiation around the reflector, thereby resulting in an increase in beamwidth. By carefully adjusting the reflector height, the beamwidth can be adjusted to any value in the range of 80° to 110°, without de-tuning the antenna's impedance matching. In the present embodiment of the invention, shown in FIG. 2, adjustment of the reflector is accomplished by mounting the reflector 42 to a digital stepper motor 46 that is operated by a microprocessor controller 48. It will be recognized that other spacing control adjusters may be devised and suitably utilized.

Thus, the present invention provides an efficient way to achieve adjustable wide-beamwidth (between 80° and 110°) for various wireless systems in a three-sector configuration, which requires coverage of a 120° geographic area. It not only extends the beamwidth of a traditional patch antenna from 60°–70° to over 90°, but also provides a readily adjustable beamwidth. The invention thus allows patch antennas to be used in applications such as three-sector base station radiators. Thus, the conventional dipole antennas can be replaced by these low-cost, low-profile, and highly-integrated patch antennas.

Further, using the present invention, it is possible to engineer cell boundaries in a cellular network to be adjustable, such that cell loading can be properly managed and optimized depending upon such variables as the time of day, season, and geographical area. This approach can be realized by employing a base station antenna with the above-described beamwidth control capability.

Figure 3A:
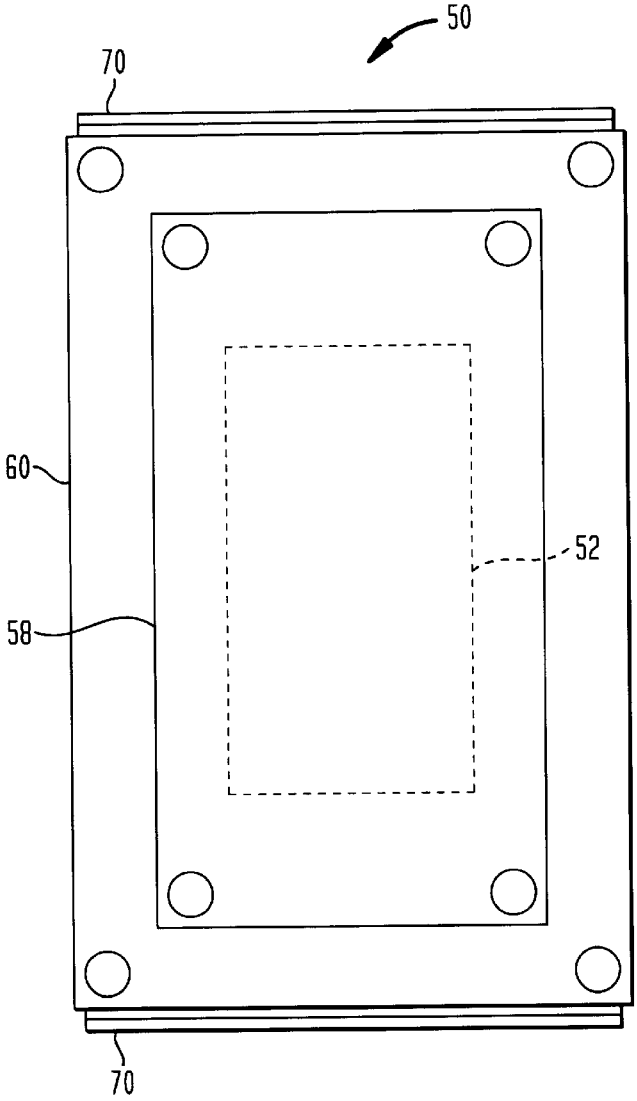
FIGS. 3A through 3D show, respectively, top, side, front, and bottom views of a further embodiment of a microstrip patch antenna according to the present invention.
Figure 3B:
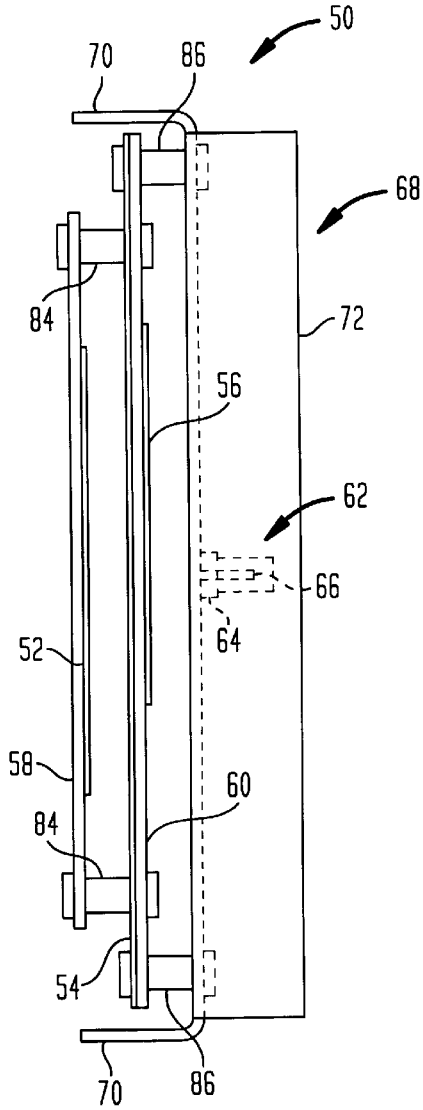
Figure 3C:
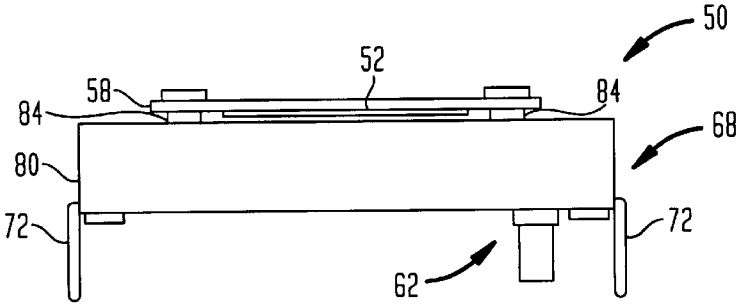
Figure 3D:
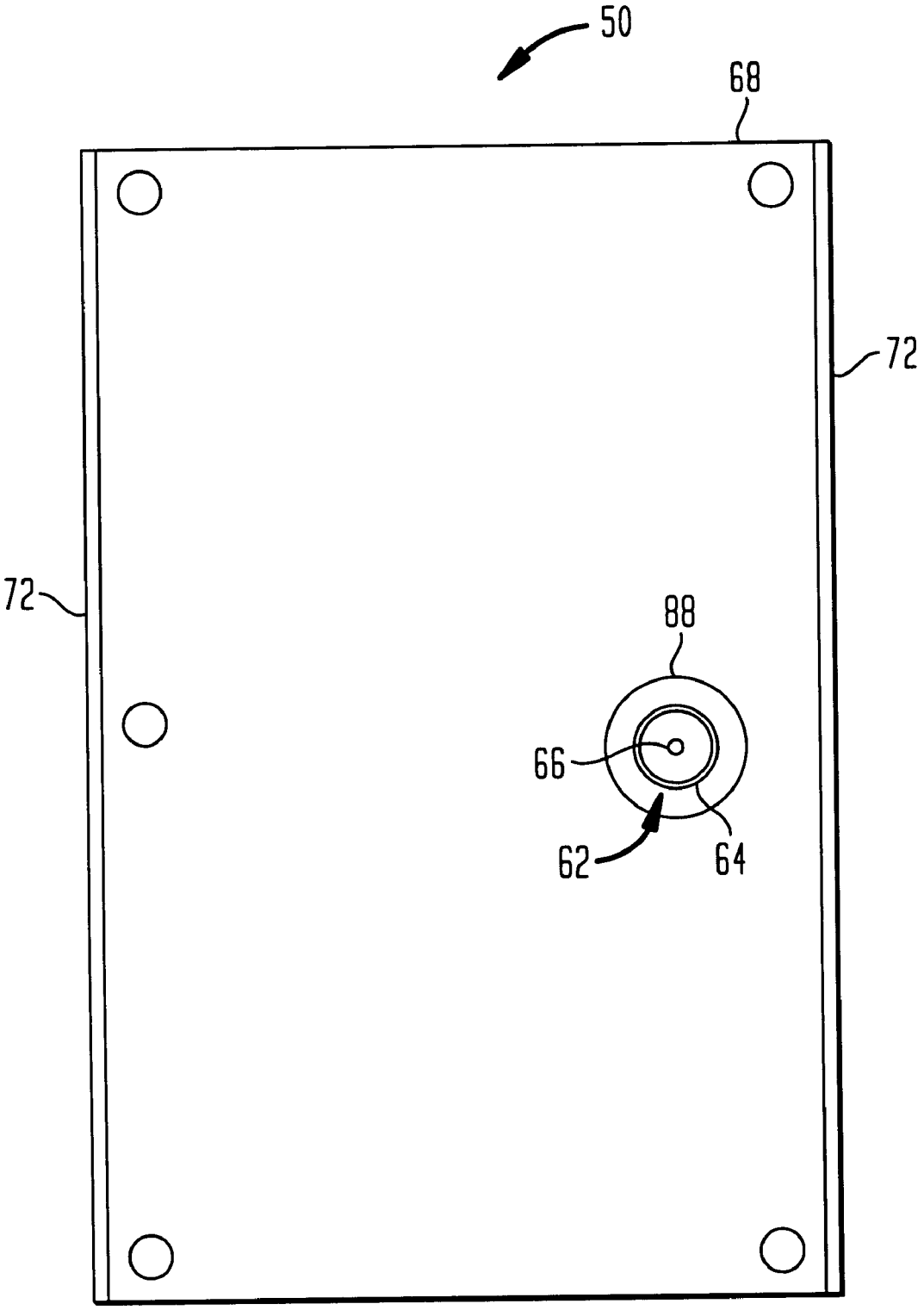
Figure 4:
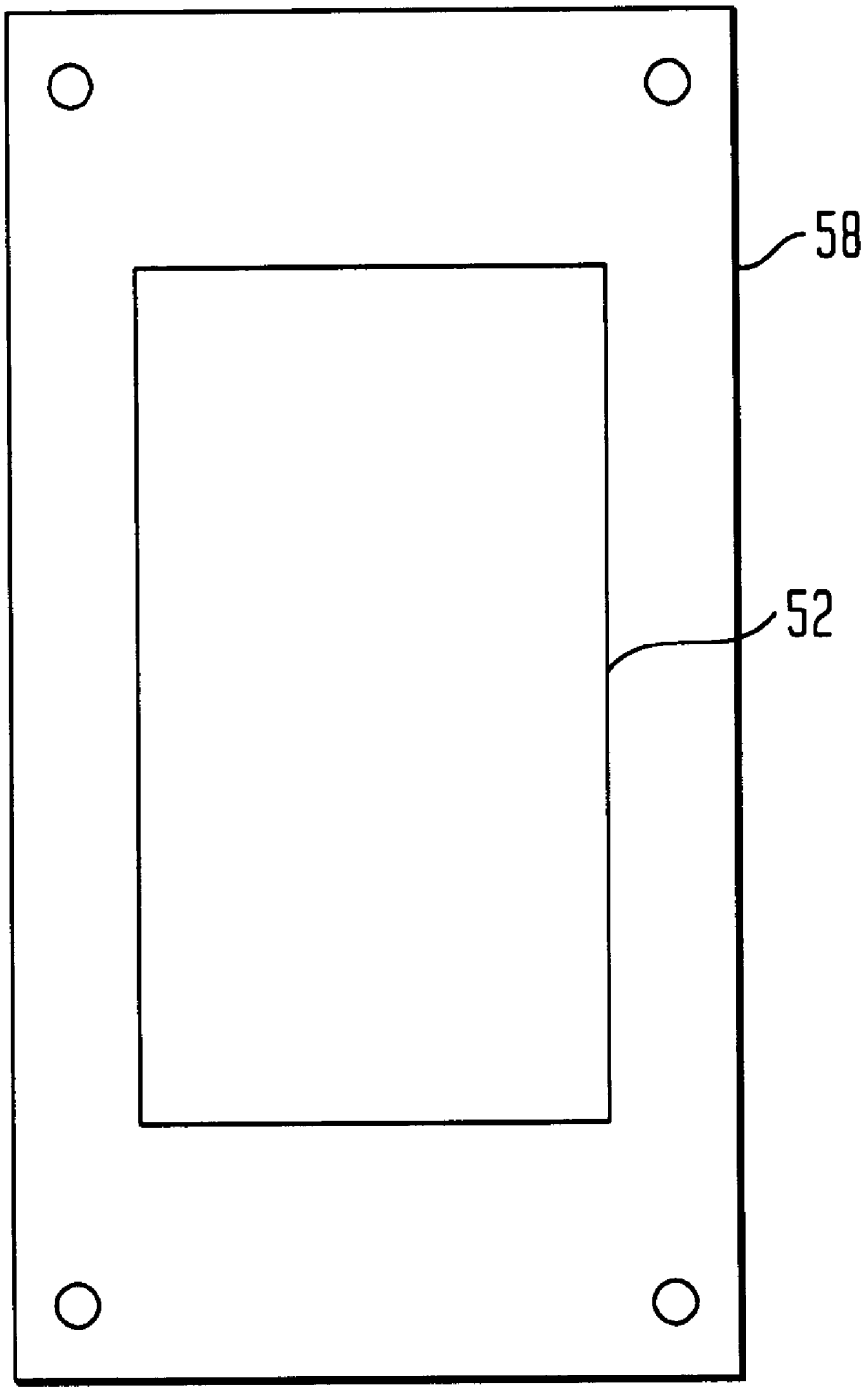
FIG. 4 shows a bottom view of the top substrate layer of the antenna shown in FIGS. 3A through 3D.
Figure 5A:
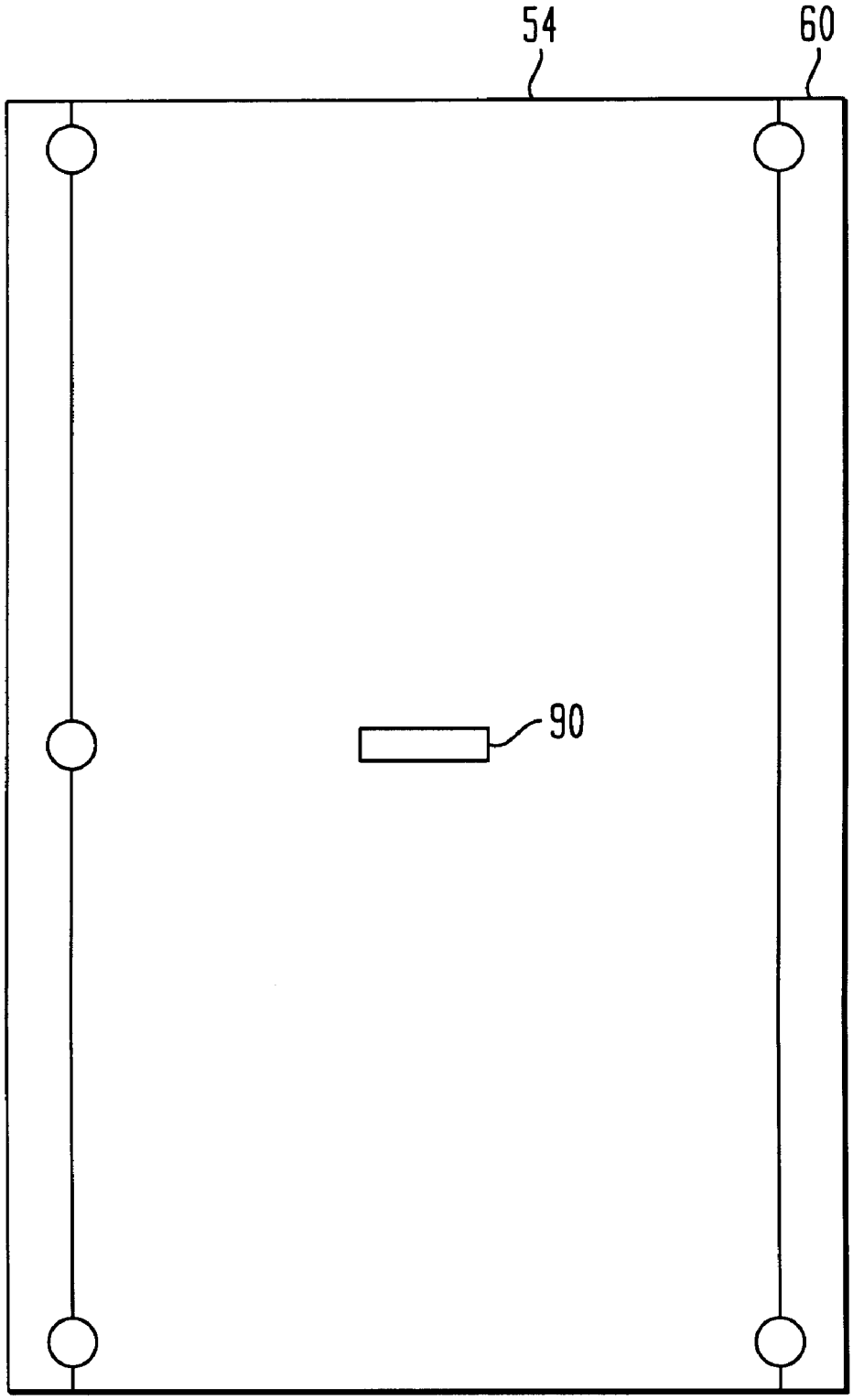
FIGS. 5A through 5C show, respectively, top, bottom, and side views of the bottom substrate layer of the antenna shown in FIGS. 3A through 3D.
Figure 5B:
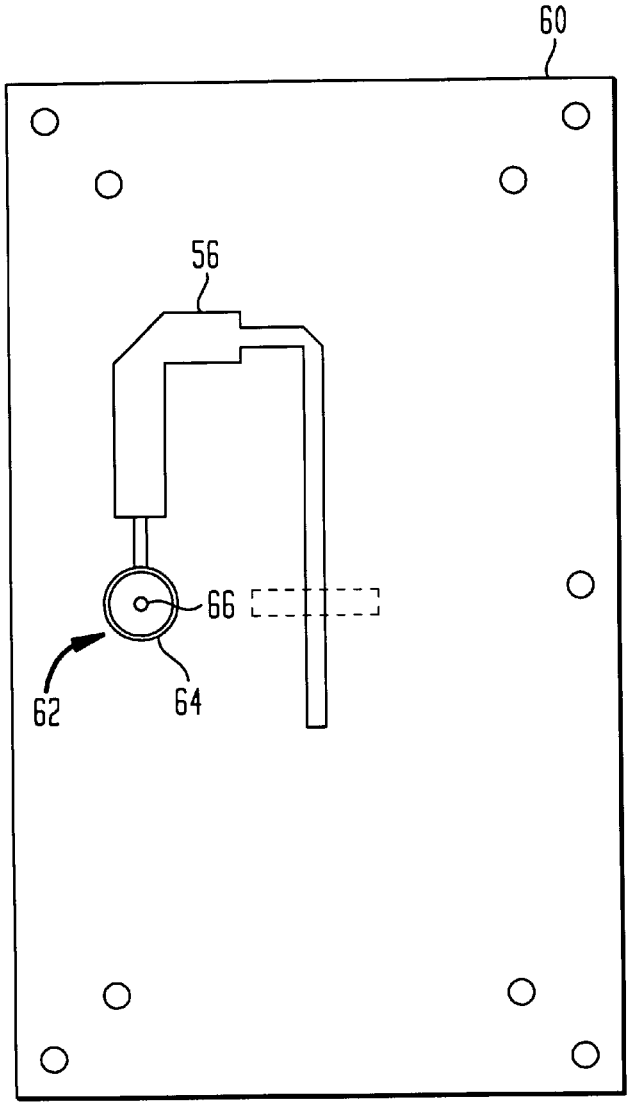

FIGS. 3A through 3D show, respectively, top, right side, front, and bottom views of a further embodiment of an antenna 50 according to the present invention. The antenna includes a patch element 52, a finite ground plane 54, and a microstrip feed line 56 that are laid onto upper and lower dielectric substrates 58 and 60. The patch element 52, shown in greater detail in FIG. 4, is a relatively narrow rectangle that is fabricated onto the bottom surface of the upper dielectric substrate 58. The finite ground plane 54, shown in greater detail in FIG. 5A, is fabricated onto the top surface of the lower dielectric substrate 60. The microstrip feed line 56, shown in greater detail in FIG. 5B, is fabricated onto the bottom surface of the lower dielectric substrate 60. The microstrip feed line 56 is fed by a coaxial feed 62, the outer conductor 64 of which is electrically connected to the finite ground plane 54 and the inner conductor 66 of which is electrically connected to the microstrip feed line 66. Finally, a metal reflector 68 is provided to reflect radiation towards the top of the antenna 50. The reflector 68 includes a first pair of wing members 70 extending upward around the lower substrate 60 and a second pair of wing members 72 extending downward around the coaxial feed 62. As shown in FIG. 3D, the reflector 68 includes a hole 88 through which the coaxial feed 62 passes.

In the present embodiment of the antenna, the upper and lower substrates 58 and 60 are separated from each other by a set of four spacers 84. This creates a layer of air between the patch element 52 and the ground plane 54. If desired, the layer of air can be replaced by a solid substrate. A second set of four spacers 86 is used to separate the lower substrate 60 from the reflector plate 68. In an embodiment of the invention in which the reflector plate 68 is adjustable, the four spacers 84 are replaced by a movable mounting assembly that allows the reflector plate 68 to be moved precisely relative to the upper and lower substrates 58 and 60 while maintaining a parallel relationship with those elements. In that embodiment, the movement of the reflector plate 68 is controlled using a microprocessor-controlled stepper motor, as shown in FIG. 2.

FIG. 4 shows a bottom view of the upper substrate 58 with the metallic patch element 52 fabricated thereon. As discussed above, according to the present invention the shape of the patch element 52 is a relatively narrow rectangle having a width that is 60% or less of its length. However, it would also be possible to practice the present invention using a square patch element 52.

FIG. 5A shows a top view of the lower substrate 60. The finite ground plane 54 is fabricated onto the substrate 60, and includes at its center a rectangular aperture 90. In the embodiment shown in FIG. 5A, the aperture 90 only extends through the ground plane 54. It does not extend through the substrate 60, although it would be possible to do so, if desired. As discussed above, the size of the ground plane 54 relative to the aperture 90 is such that the ground plane 54 functions as a finite surface with respect to the aperture 90.

Figure 5C:
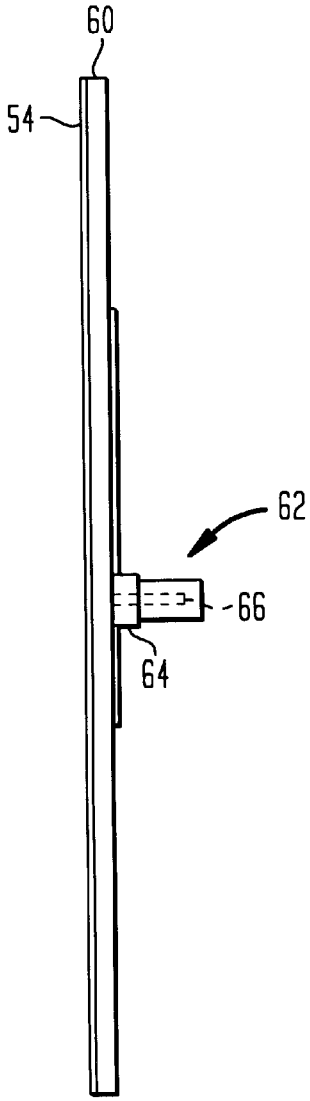

FIGS. 5B and 5C show, respectively, bottom and side views of the lower substrate 60. The microstrip feed line 56 is fabricated directly onto the bottom surface of the lower substrate 60 and extends across the aperture 90 in the ground plane 54. As mentioned above, the aperture 90 does not extend all the way through the substrate 60. The coaxial feed 62 is mounted perpendicular to the lower substrate 60. Its inner conductor 66 is electrically connected to the microstrip feed line 56. Its outer conductor 64 extends through the lower substrate 60 and is electrically connected to the ground plane 54 on the other side of the substrate 60.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. An antenna, comprising:

a patch element;

a ground plane separated from the patch element by a first dielectric layer;

a signal feed line separated from the ground plane by a second dielectric layer, the signal feed line being shielded from the patch element by the ground plane;

the signal feed line being electromagnetically coupled to the patch element through an aperture in the ground plane lying across the signal feed line, the ground plane functioning as a finite surface relative to the aperture, wherein the width of the ground plane is less than one-half wavelength of the operation frequency, thereby allowing measurable beamwidth variation due to variant reflector positions.

2. The antenna of claim 1, wherein the patch element is a rectangle having a width that is 60 percent or less of its length.

3. The antenna of claim 1, further including:

a reflector proximate to the signal feed line for reflecting radiation from the signal feed line, the reflector being positioned such that the signal feed line is between the ground plane and the reflector.

4. The antenna of claim 3, wherein the position of the reflector is adjustable, an adjustment of the position of the reflector producing a change in the amount of spill of radiation around the reflector.

5. The antenna of claim 4, wherein the position of the reflector is adjusted by a stepper motor.

6. The antenna of claim 5, wherein the stepper motor is operated by a nicroprocessor controller.

7. The antenna of claim 1, further including a coaxial feed, the outer conductor of which is connected to the ground plane and the inner conductor of which is connected to the signal feed line.

8. An antenna, comprising:

a patch element fabricated onto the top surface of a first substrate;

a ground plane fabricated between the bottom surface of the first substrate and the top surface of a second substrate; and a signal feed line fabricated onto the bottom surface of the second substrate, the signal feed line being coupled to the patch element through an aperture in the ground plane lying across the signal feed line, the ground plane functioning as a finite surface relative to the aperture, wherein the width of the ground plane is less than one-half wavelength of the operation frequency, thereby allowing measurable beamwidth variation due to variant reflector positions.

9. The antenna of claim 8, wherein the patch element is a rectangle having a width that is 60 percent or less of its length.

10. The antenna of claim 8, further including:

a reflector proximate to the signal feed line for reflecting radiation from the signal feed line, the reflector being positioned such that the signal feed line is between the ground plane and the reflector.

11. The antenna of claim 10, wherein the position of the reflector is adjustable, an adjustment of the position of the reflector producing a change in the amount of spill of radiation around the reflector.

12. An antenna, comprising:

a patch element fabricated onto the bottom surface of a first substrate;

a ground plane fabricated onto the top surface of a second substrate, the patch element and the ground plane being separated by a layer of air;

a signal feed line fabricated onto the bottom surface of the second substrate, the signal feed line being coupled to the patch element through an aperture in the ground plane lying across the signal feed line, the ground plane functioning as a finite surface relative to the aperture, wherein the width of the ground plane is less than one-half wavelength of the operation frequency, thereby allowing measurable beamwidth variation due to variant reflector positions.

13. The antenna of claim 12, wherein the patch element is a rectangle having a width that is 60 percent or less of its length.

14. The antenna of claim 12, further including:

a reflector proximate to the signal feed line for reflecting radiation from the signal feed line, the reflector being positioned such that the signal feed line is between the ground plane and the reflector.

15. The antenna of claim 14, wherein the position of the reflector is adjustable, an adjustment of the position of the reflector producing a change in the amount of spill of radiation around the reflector.

16. A method for manufacturing an antenna, comprising the following steps:

(a) fabricating a patch element onto a first surface;

(b) fabricating a signal feed line onto a second surface;

(c) separating the patch element from the signal feed line by a finite ground plane, having a width of less than one-half wavelength of the operation frequency, thereby allowing measurable beamwidth variation due to variant reflector positions;

(d) electromagnetically coupling the signal feed line with the patch element through an aperture in the ground plane lying across the signal feed line.

17. The method of claim 16, further including:

(e) positioning a reflector such that the signal feed line is between the ground plane and the reflector.

18. The method of claim 17, further including:

(f) adjusting the antenna beamwidth by adjusting the position of the reflector such that there is an adjustment in the amount of spill of radiation around the reflector.

19. A base station radiator, comprising:

a plurality of patch antennas, each patch antenna including a patch element;

a ground plane separated from the patch element by a first dielectric layer;

a signal feed line separated from the ground plane by a second dielectric layer, the signal feed line being shielded from the patch element by the ground plane;

the signal feed line being electromagnetically coupled to the patch element through an aperture in the ground plane lying across the signal feed line, the ground plane functioning as a finite surface relative to the aperture, wherein the width of the ground plane is less than one-half wavelength of the operation frequency, thereby allowing measurable beamwidth variation due to variant reflector positions.

20. The base station radiator of claim 19, wherein each patch antenna the patch element is a rectangle having a width that is 60 percent or less of its length.

21. The base station radiator of claim 19, wherein each patch antenna further includes:

a reflector proximate to the signal feed line for reflecting radiation from the signal feed line, the reflector being positioned such that the signal feed line is between the ground plane and the reflector.

22. The base station radiator of claim 21, wherein the position of the reflector in each patch antenna is adjustable an adjustment of the position of the reflector producing a change in the amount of spill of radiation around the reflector, thereby producing an adjustment in the antenna beamwidth.

23. The base station radiator of claim 22, wherein the position of the reflector in each patch antenna is adjusted by a stepper motor.

* * * * *